US007708555B2

(12) United States Patent
Groehl

(10) Patent No.: US 7,708,555 B2
(45) Date of Patent: May 4, 2010

(54) GAS-FIRED HEATING UNIT

(75) Inventor: Alexander Groehl, Dolgesheim (DE)

(73) Assignee: Ceramat, S. Coop., Asteasu (Gipuzkoa) (ES)

( * ) Notice: Subject to any disclaimer, the term of this patent is extended or adjusted under 35 U.S.C. 154(b) by 946 days.

(21) Appl. No.: 11/224,552

(22) Filed: Sep. 12, 2005

(65) Prior Publication Data

US 2006/0057531 A1 Mar. 16, 2006

(30) Foreign Application Priority Data

Sep. 14, 2004 (DE) ..... 10 2004 044 445

(51) Int. Cl.
*F23D 14/12* (2006.01)

(52) U.S. Cl. ..... 431/328; 431/329; 431/354

(58) Field of Classification Search ..... 126/92 AC; 431/354, 328, 329, 114, 350; 249/354, 328, 249/329, 114, 350
See application file for complete search history.

(56) References Cited

U.S. PATENT DOCUMENTS 4,953,510 A 9/1990 Akkala et al.
5,875,739 A 3/1999 Joyce
5,957,682 A * 9/1999 Kamal et al. ..... 431/328
6,725,811 B1 4/2004 Moore, Jr. et al.
2003/0111023 A1 6/2003 Carbone et al.

FOREIGN PATENT DOCUMENTS

DE 43 29 194 A1 3/1995

* cited by examiner

*Primary Examiner*—Alfred Basichas
(74) *Attorney, Agent, or Firm*—Michael J. Striker

(57) ABSTRACT

The gas-fired heating unit has an atmospheric gas burner including a mixing chamber and a burner medium covering the mixing chamber, a combustion chamber in which the atmospheric gas burner is arranged, a fuel gas/air supply system that has respective inlets for fuel gas and combustion air and an ignition device having at least one pilot flame and supply pipe for pilot flame gas associated the mixing chamber. In order to reduce $NO_x$ emissions and reduce ignition noise, the ignition device has an upwardly open mixing space arranged in the mixing chamber and immediately under the burner medium, the supply pipe for the pilot flame gas is connected to the mixing space and the mixing space is provided with an inlet for primary air.

16 Claims, 3 Drawing Sheets

GAS-FIRED HEATING UNIT

BACKGROUND OF THE INVENTION

1. Field of the Invention

The present invention relates to a gas-fired heating unit comprising at least one atmospheric gas burner provided with a mixing chamber and a burner medium covering the mixing chamber, a combustion chamber inside of which the at least one atmospheric gas burner is arranged, a fuel gas/air supply system that has respective inlets for fuel gas and combustion air arranged outside of the combustion chamber on the heating apparatus, and an ignition device having at least one pilot flame and supply pipe for pilot flame gas.

2. Related Art

These types of gas-fired heating units, to which the invention is related, typically include gas-fired water heaters or gas-fired heating apparatuses, like those used for industrial heating and fireplaces in homes, i.e. for space heating.

Gas-fired water heaters are used in many different forms and in many different power stages in different applications both in the private and also the industrial sector.

This sort of gas-fired water heater is used, for example, for preparation of heated service water in industry or of hot water for heating in homes.

A special embodiment of this sort of gas-fired hot water preparing apparatus is the so-called "water heater" marketed in the U.S.A., which typically prepares and stores shower water for workplaces, homes or the like. For example one such "water heater" is described in U.S. Pat. No. 4,953,510, which comprises a thermally insulated storage tank for supplying heated water.

U.S. Pat. No. 5,875,739 A and U.S. Published patent application 2003/0111 023 A1 disclose a further form of a "water heater", in which a pre-mixing gas burner, a so-called pre-mix burner, is arranged in a nearly completely closed combustion chamber. This gas burner has a mixing chamber, which is covered with a burner medium preferably a burner mat, and a Venturi pipe connected to the mixing chamber below the burner mat, which extends through the wall of the combustion chamber until at an outside surface of the water heater. A nozzle for supplying fuel gas is arranged within the outlet opening of the Venturi. Primary air, which is then mixed further in the mixing chamber with the fuel gas by convection, is drawn in though this outlet opening when fuel gas flows into this Venturi because of gas flow action.

The invention is used in a gas-fired heating apparatus or unit, especially a water heater having a gas burner of the above-described type.

Usually ignition flames, so-called pilot flames, are used for ignition. For this purpose the gas burner has a small pipe of a smaller diameter outside of the mixing chamber, in which fuel gas flows from below and the ignition flame burns with secondary air at the outlet of this small pipe, which is arranged immediately at the edge of the burner mat.

This structure has a comparatively very high $NO_x$ emission. Also the ignition of the main burner is comparatively loud, because the ignition and pilot flame "sets" onto the burner mat of the gas burner at the moment of ignition, i.e. spreads out suddenly on it.

SUMMARY OF THE INVENTION

It is an object of the present invention to provide a gas-fired heating unit of the above-described kind with an ignition device, in which the ignition device produces comparatively lower emissions and less noise than ignition devices used in prior art gas-fired heating units.

This object and others, which will be made more apparent hereinafter, are attained in a gas-fired heating unit comprising at least one atmospheric gas burner, each of which includes a mixing chamber and a burner medium covering the mixing chamber; a combustion chamber inside of which the at least one atmospheric gas burner is arranged; a fuel gas/air supply system for supplying fuel gas and combustion air to the mixing chamber of each atmospheric gas burner, which has respective inlet means for fuel gas and combustion air arranged outside of the combustion chamber; and an ignition device for the at least one atmospheric gas burner, which has at least one pilot flame and at least one supply pipe for supplying pilot flame gas to the at least one pilot flame.

According to the invention the ignition device has a respective upwardly open mixing space arranged in the mixing chamber of each atmospheric gas burner and immediately under the burner medium thereof, the at least one supply pipe for supplying the at least one pilot flame gas is connected to the respective upwardly open mixing space and the respective upwardly open mixing space is provided with a corresponding mixing space inlet for primary air.

Because of the features of the invention the pilot flame produces comparatively small $NO_x$ emissions. Furthermore a sound-less or noise-less ignition of the gas burner is possible.

Further embodiments and features of the invention are disclosed in the following detailed description and claimed in the appended dependent claims.

In preferred embodiments of the invention the burner medium is a burner mat, which rests loosely on the mixing chamber, so that the corresponding mixing space inlet for primary air is gap-shaped, for example a gap between the burner mat and a wall of the mixing space, and provides a respective burning surface for the at least one pilot flame. The mixing space is preferably provided under an edge of the burner mat, but may be placed at any arbitrary position under the burner mat. The burner mat may be rectangular, circular, oval or a free form.

The gas-fired heating unit may be a water heating apparatus, a space heater or a water heater for storing and supplying heated water, for example in a private home.

BRIEF DESCRIPTION OF THE DRAWING

The objects, features and advantages of the invention will now be illustrated in more detail with the aid of the following description of the preferred embodiments, with reference to the accompanying figures in which.

DETAILED DESCRIPTION OF THE INVENTION

Figure 1:
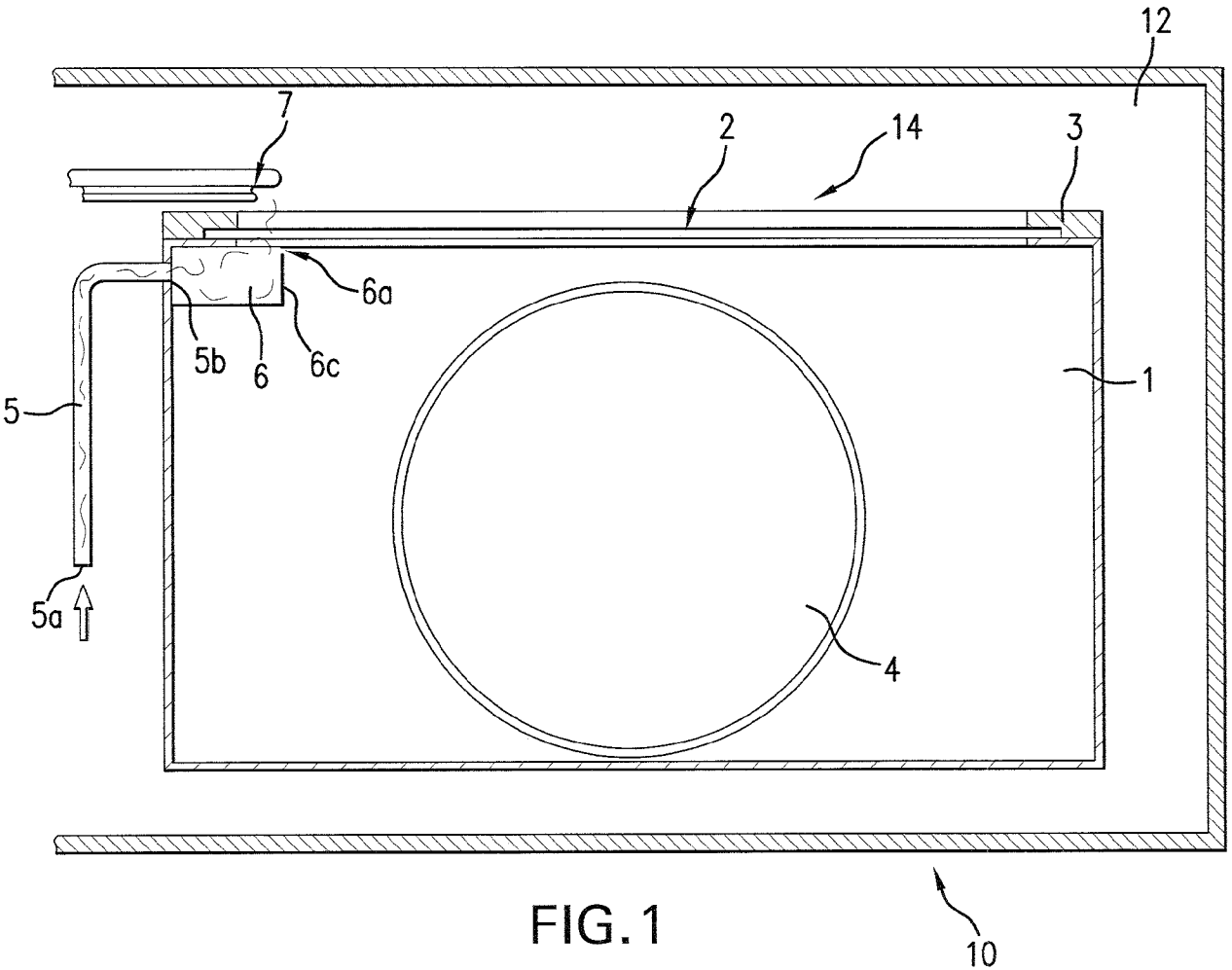
FIG. 1 is a diagrammatic longitudinal cross-sectional view of a first embodiment of a gas-fired heating unit according to the invention with an atmospheric gas burner arranged in its combustion chamber together with a complete pre-mixing fuel gas/air supply system and an igniting device with a pilot flame for the gas burner.
Figure 2:
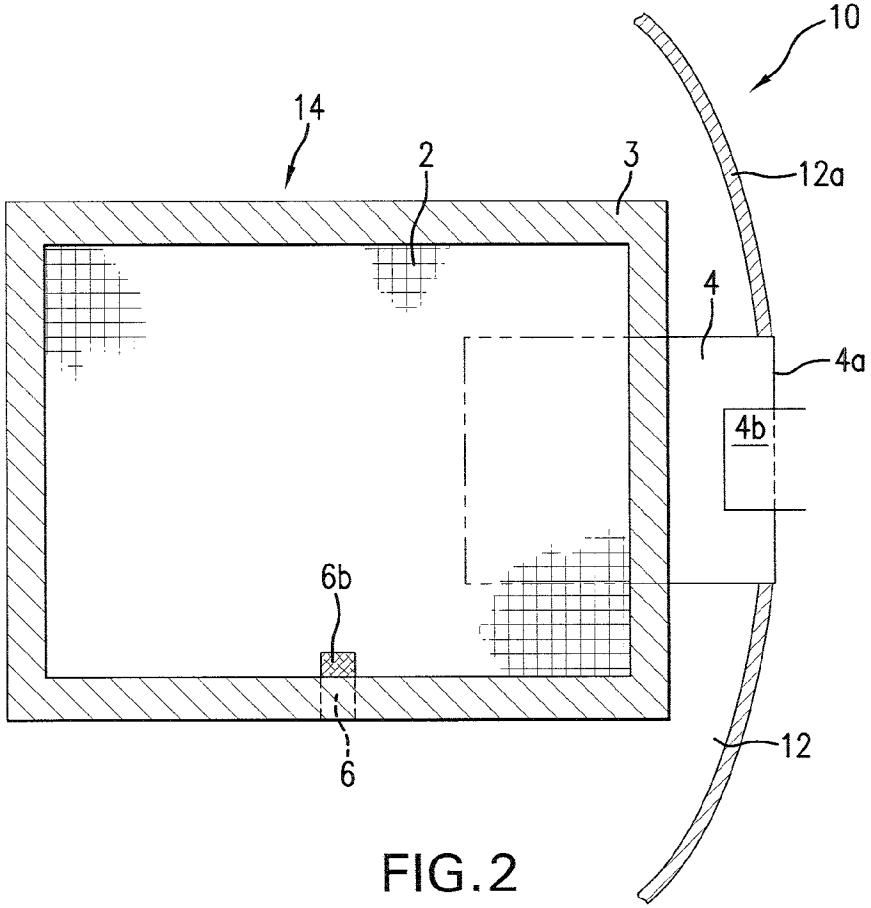
FIG. 2 is a top plan view of a gas-fired heating unit according to the invention with the single gas burner in the combustion chamber as shown in FIG. 1, which shows the pilot flame's burning surface inside the gas burner.

FIGS. 1 and 2 show different views of a conventional gas burner 14 arranged within a combustion chamber 12 of a gas-fired heating unit 10. The combustion chamber 12 has a combustion chamber wall 12*a*, which is the only part of the combustion chamber shown in FIG. 2. This conventional gas burner 14 20 includes mixing chamber 1, which is covered on top by a rectangular burner medium, which is peripherally attached to the mixing chamber by means of a peripheral attachment ring 3. The rectangular burner medium comprises a conventional part, e.g. like the burner mat 2 made from ceramic fibers, which is known under the trademark Schott CERAMAT®. The burner mat 2 can also be circular, oval or a free form. Also it is possible that it is made from metal fibers. Furthermore the burner medium can comprise a ceramic mat or perforated plate.

A complete pre-mixing fuel gas/air supply system 4 for supplying the mixing chamber 1 with fuel gas and air is mounted in one side of the mixing chamber 1. This fuel gas/air supply system 4 typically comprises a Venturi pipe with an inlet 4*a* for primary air and a connected fuel gas nozzle 4*b* for supplying fuel gas.

Other known embodiments of devices for mixing the fuel gas and air, for example a mixing pipe can be employed.

In principle any complete pre-mixing gas burner can be used in the heating unit according to the invention.

Various possible structural forms of the gas burner with mixing chamber, burner medium and fuel gas/air supply system are known in themselves and do not need to be described in more detail here. The symbolic representation of these parts shown in the drawing should be sufficient for illustrating and understanding the presently claimed invention.

The invention relates to the ignition device for the gas burner and of course particularly to the production of the associated pilot flame.

The ignition device comprises ignition components 7 above the burner mat and a gas supply pipe 5 with a comparatively small diameter for producing the pilot flame. The pilot flame gas, as illustrated symbolically by the arrow, is supplied at the inlet end 5*a* of the gas supply pipe 5. The outlet end 5*b* of the gas supply pipe 5 opens into a mixing space 6 arranged in the burner-mixing chamber 1 under burner mat 2. The burner mat 2 is arranged or placed on the topside of the mixing space 6 loosely or without being rigidly attached thereto. This mixing space 6 has a mixing space inlet 6*a* for primary air (with fuel gas) from the burner mixing chamber 1, which is formed in the illustrated embodiment by a gap between a wall 6*c* of the mixing space 6 and the perforated burner mat 2 resting on it.

In the embodiment illustrated the mixing space 6 is arranged at the edge of the mixing chamber 1. In principle the mixing space 6 for the pilot flame can be arranged at any position in the burner mixing chamber, e.g. also in the center.

Thus pilot flame gas and primary air entering at inlet 6*a* flow through the mixing space 6. This mixture flows through the burner mat and burns as the pilot flame after ignition by the relevant conventional ignition components 7. The associated burning surface 6*b* of the pilot flame is made conspicuous by the shading in FIG. 2.

The mixing of the pilot flame fuel gas with primary air from the fuel mixing chamber produces a comparatively small exhaust gas emission of $NO_x$.

The burner mat 2 arches or buckles to some extent at the time of ignition, which results in a still larger opening 6*a* between the burner mat 2 and the mixing space 6. Still more gas mixture of the main burner flows through this mixing space opening 6*a*. Because of that the pilot flame gas mixes with the main burner gas and/or the gas is distributed uniformly over the entire burner surface so that as a result an improved combustion takes place. The mixing space gap 6*a* must be made comparatively larger when the burner material of the burner mat 2 is comparatively stiffer.

Because the pilot flame uses the burner medium of the main burner directly as flame carrier, during ignition of the main burner the pilot flame does not need to be first "set" on it. This has the result of a very "soft" ignition.

Figure 3:
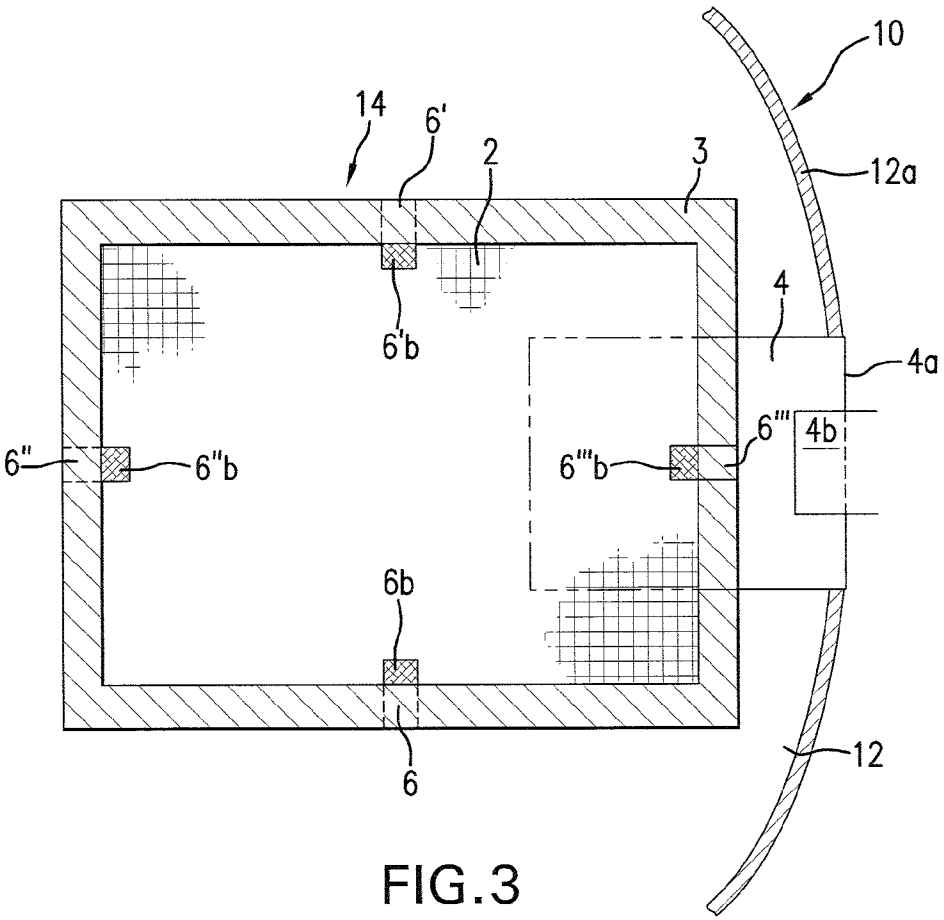
FIG. 3 is a top plan view of a second embodiment of a gas-fired heating unit according to the invention with an atmospheric gas burner in the combustion chamber, similar to that shown in FIG. 2, but with a plurality of pilot lights.

According to a further embodiment of the invention the burner has several "pilot flames", in order to permit an absolutely sound-less ignition. This further embodiment of the gas-fired heating apparatus 10 according to the invention is shown in FIG. 3. This embodiment has the same basic structure as the embodiment shown in FIG. 2, except that a plurality of pilot lights are arranged around the burner mat 2, instead of only one. Four mixing spaces 6, 6', 6" and 6'" are uniformly distributed around the periphery of the burner mat 2 in the mixing chamber 1. These mixing spaces are supplied with pilot light gas from a common source through a plurality of supply pipes, which are not shown in FIG. 3, but in a manner similar to that shown in FIG. 1. The pilot lights also receive primary air (and fuel gas) from the mixing chamber 1, as in the embodiment shown in FIGS. 1 and 2. Ignition components are provided in the vicinity of all of the pilot lights shown in FIG. 3. Otherwise the structure of the embodiment of FIG. 3 is the same as that of FIGS. 1 and 2.

The pilot flame burner surface 6*a* does not need to be rectangular, as shown in FIG. 2. It can, e.g., also be circular, i.e. it can have any conceivable form.

PARTS LIST

1 mixing chamber
2 burner medium
3 attachment ring
4 fuel gas/air supply system
4*a* inlet for primary air
4*b* fuel gas nozzle
5 gas supply pipe
5*a* inlet end
5*b* outlet end
6, 6', 6", 6'" mixing spaces
6*a* mixing space inlet
6*b*, 6'*b*,
6"*b*, 6'"*b* burning surfaces of the pilot flames
6*c* mixing space wall
7 respective conventional ignition components
10 gas-fired heating unit
12 combustion chamber
12*a* combustion chamber wall
14 atmospheric gas burner The disclosure in German Patent Application 10 2004 044 445.5-13 of Sep. 14, 2004 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a gas-fired heating unit, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

I claim:

1. A gas-fired heating unit comprising at least one atmospheric gas burner, each of said at least one atmospheric gas burner including a mixing chamber and a burner medium covering the mixing chamber;

a combustion chamber inside of which the at least one atmospheric gas burner is arranged;

a fuel gas/air supply system for supplying fuel gas and air to the mixing chamber of each of said at least one atmospheric gas burner, said fuel gas/air supply system having respective inlet means for the fuel gas and the air arranged outside of the combustion chamber; and an ignition device for the at least one atmospheric gas burner, said ignition device having at least one pilot flame and at least one supply pipe for supplying pilot flame gas to the at least one pilot flame;

wherein the ignition device has a respective partially-enclosed secondary chamber configured as an upwardly open mixing space arranged in the mixing chamber of each of said at least one atmospheric gas burner and immediately under the burner medium thereof, wherein the at least one supply pipe for supplying the at least one pilot flame gas is connected to the respective partially-enclosed secondary chamber and wherein the respective partially-enclosed secondary chamber is provided with a corresponding mixing space inlet for primary air.

2. The gas-fired heating unit as defined in claim 1, wherein the burner medium is a burner mat, which rests loosely on the mixing chamber of each of the at least one atmospheric gas burner, so that said corresponding mixing space inlet for primary air is a gap provided between a wall of the partially-enclosed secondary chamber and the burner mat and the burner mat provides a burning surface for each of the at least one pilot flame.

3. The gas-fired heating unit as defined in claim 2, wherein said burning surface of each of the at least one pilot flame is rectangular.

4. The gas-fired heating unit as defined in claim 2, wherein said burning surface of each of the at least one pilot flame is circular.

5. The gas-fired heating unit as defined in claim 2, wherein said burning surface of each of the at least one pilot flame has a free form shape.

6. The gas-fired heating unit as defined in claim 1, wherein said respective partially-enclosed secondary chamber is arranged at an arbitrary position within each of the mixing chambers.

7. The gas-fired heating unit as defined in claim 6, wherein said arbitrary position is arranged at an edge of the mixing chamber in which the respective partially-enclosed secondary chamber is arranged.

8. The gas-fired heating unit as defined in claim 1, consisting of an apparatus for space heating.

9. The gas-fired heating unit as defined in claim 1, consisting of an apparatus for heating water.

10. The gas-fired heating unit as defined in claim 1, consisting of a water heater.

11. A gas-fired heating unit comprising at least one atmospheric gas burner, each of said at least one atmospheric gas burner comprising a mixing chamber and a burner medium covering the mixing chamber;

a combustion chamber inside of which each of the at least one atmospheric gas burner is arranged;

a fuel gas/air supply system for the at least one atmospheric gas burner, said fuel gas/air supply system having respective inlet means for fuel gas and combustion air arranged outside of the combustion chamber, and a respective ignition device for each of the at least one atmospheric gas burners, said respective ignition device having a plurality of pilot flames for said mixing chamber and a plurality of supply pipes for supplying pilot flame gas to the pilot flames;

wherein the respective ignition device has a plurality of partially-enclosed secondary chambers configured as upwardly open mixing spaces arranged in the mixing chamber associated therewith and immediately under the burner medium, wherein said supply pipes for the pilot flame gas are connected to said partially-enclosed secondary chambers and wherein said partially-enclosed secondary chambers are each provided with an associated mixing space inlet for primary air.

12. The gas-fired heating unit as defined in claim 11, wherein the burner medium is a burner mat, which rests loosely on the mixing chamber, so that said mixing space inlet of each of said partially-enclosed secondary chambers is formed by a gap between a mixing space wall and the burner mat and the burner mat provides a burning surface for the pilot flames.

13. The gas-fired heating unit as defined in claim 11, wherein said partially-enclosed secondary chambers are arranged at arbitrary positions within each of the mixing chambers.

14. The gas-fired heating unit as defined in claim 11, wherein said partially-enclosed secondary chambers are uniformly distributed around an outer periphery or circumference of the mixing chamber at or under an edge of said burner mat.

15. The gas-fired heating unit as defined in claim 12, wherein a respective portion of said burning surface for each of the pilot flames is rectangular, circular or a free form.

16. The gas-fired heating unit as defined in claim 11, consisting of an apparatus for space heating, an apparatus for heating water or a water heater.

* * * * *